US012258695B2

(12) United States Patent
Auer

(10) Patent No.: US 12,258,695 B2
(45) Date of Patent: Mar. 25, 2025

(54) MANIPULATION DEVICE FOR MATERIAL WEBS TO BE SUTURED BY MEANS OF A SEWING MACHINE

(71) Applicant: 3CON ANLAGENBAU GmbH, Ebbs (AT)

(72) Inventor: Hannes Auer, Schwoich (AT)

(73) Assignee: 3CON ANLAGENBAU GmbH, Ebbs (AT)

( * ) Notice: Subject to any disclaimer, the term of this patent is extended or adjusted under 35 U.S.C. 154(b) by 153 days.

(21) Appl. No.: 17/917,727

(22) PCT Filed: Feb. 26, 2021

(86) PCT No.: PCT/EP2021/054818
§ 371 (c)(1),
(2) Date: Apr. 14, 2023

(87) PCT Pub. No.: WO2021/204461
PCT Pub. Date: Oct. 14, 2021

(65) Prior Publication Data

US 2024/0026585 A1 Jan. 25, 2024

(30) Foreign Application Priority Data

Apr. 9, 2020 (EP) ..... 20168924

(51) Int. Cl.
*D05B 35/10* (2006.01)
*D05B 27/10* (2006.01)

(52) U.S. Cl.
CPC ..... *D05B 35/10* (2013.01)

(58) Field of Classification Search
CPC ..... D05B 35/10; D05B 35/00; D05B 35/02; D05B 69/02; D05B 27/00; D05B 27/10; D05B 27/12; D05B 27/14
See application file for complete search history.

(56) References Cited

U.S. PATENT DOCUMENTS 4,292,908 A * 10/1981 Blessing ..... D05B 35/105 112/470.31
4,928,611 A * 5/1990 Ogawa ..... B29C 66/83411 38/1 B
4,955,307 A * 9/1990 Kolb ..... D05B 33/00 112/304
5,054,409 A * 10/1991 Schips ..... D05B 35/102 112/306

(Continued)

FOREIGN PATENT DOCUMENTS

DE 39 17 120 12/1989
EP 0 383 045 8/1990

OTHER PUBLICATIONS

International Search Report with English Translation for PCT/EP2021/054818, mailed Mar. 16, 2021, 4 pages.

(Continued)

*Primary Examiner* — Ismael Izaguirre
(74) *Attorney, Agent, or Firm* — Nixon & Vanderhye P.C.

(57) ABSTRACT

A manipulation device for material webs by a sewing machine is disclosed having at least one transverse conveying device including a rolling support unit on which freely rotatable guiding rollers are arranged. The rolling support unit includes a joint chain with a straight pressing portion on which a plurality of guiding rollers is supported.

10 Claims, 6 Drawing Sheets

(56) References Cited

Figure 1:
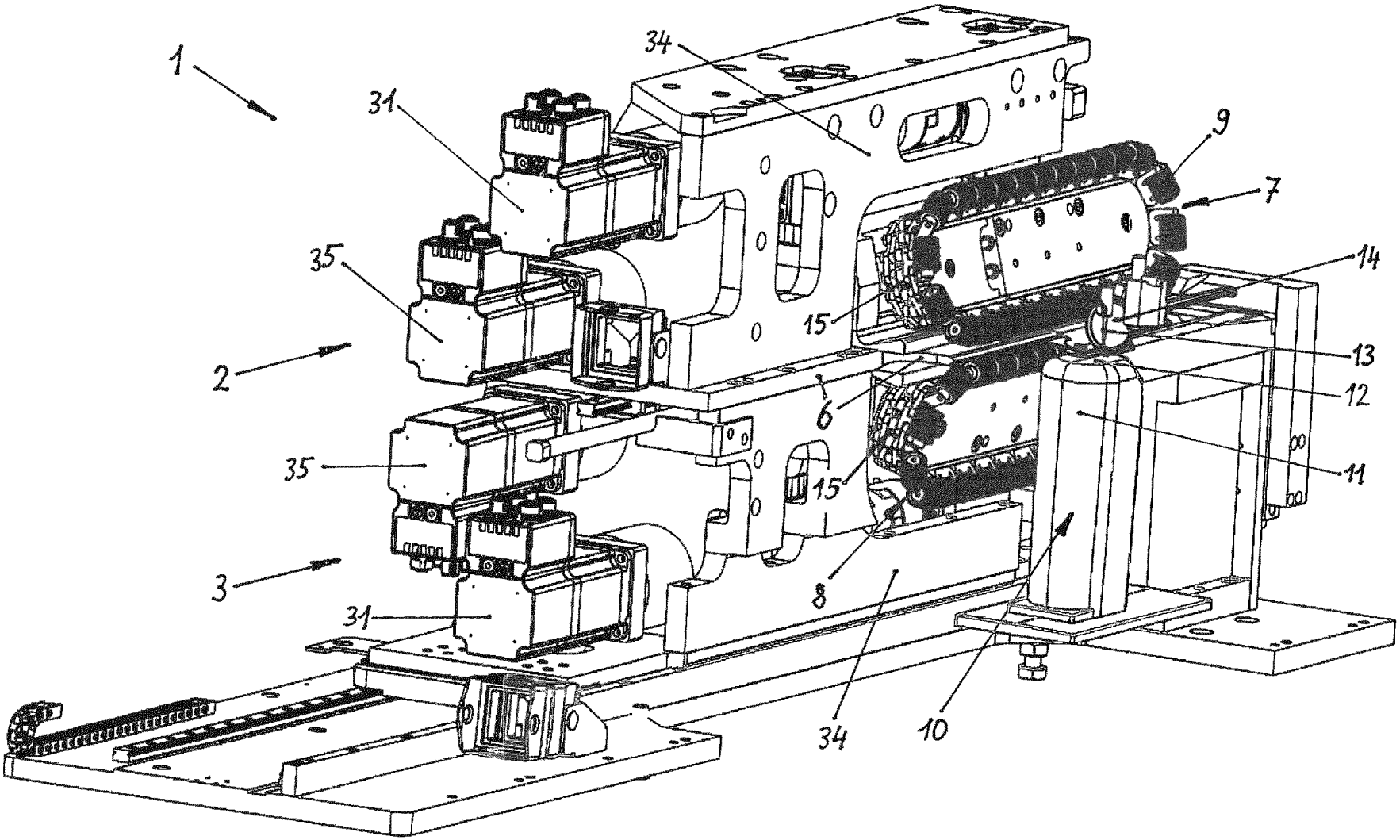

U.S. PATENT DOCUMENTS 5,370,072 A * 12/1994 Adamski, Jr. ..... D05B 35/102
112/306
5,568,778 A * 10/1996 Sahl ..... D05B 35/102
112/306

OTHER PUBLICATIONS

Written Opinion of the ISA for PCT/EP2021/054818, mailed Mar. 16, 2021, 6 pages.

* cited by examiner

MANIPULATION DEVICE FOR MATERIAL WEBS TO BE SUTURED BY MEANS OF A SEWING MACHINE

CROSS REFERENCE TO RELATED APPLICATIONS

The present application is a National Phase of International Application Number PCT/EP2021/054818 filed Feb. 26, 2021, which designated the U.S. and claims priority benefits from European Patent Application Number EP 20168924.7, filed Apr. 9, 2020, the entire contents of each of which are hereby incorporated by reference.

The invention relates to a manipulation device for material webs to be sutured by means of a sewing machine, having at least one transverse conveying device for moving the material web while sewing transversely to the sewing direction, according to the preamble of claim 1.

In the automotive sector, sewn coverings are needed for the interior fittings in order to cover base supports with these sewn coverings. Here, the sewn coverings frequently consist of a plurality of material webs in the form of individual fabric, synthetic leather or real leather cuts, which are joined by means of sewing and/or are provided with ornamental stitching in some instances.

A particular difficulty arises in that material web cuts often have to be sutured with incongruent contours in such a way that a three-dimensional sewn covering results. This requires the highest degree of precision on the part of the sewer when the material web cuts are fed to a sewing machine by hand and sutured.

Further, from DE 39 17 120 A1, a manipulation device which works with a sewing machine according to the preamble of claim 1 is known, which, during the sewing process without the assistance of a sewer, enables an automatic alignment in the transverse direction of the material web cuts to be sutured. The alignment of the fabric layers is there achieved by upper and lower transverse conveying devices in the form of circular guiding wheels, which carry a plurality of freely rotatable rollers on their circumference. The guiding wheels can be turned by step motors depending on alignment correction values. Hereby, the two fabric layers should be moved transversely to the sewing direction in such a way that the degree of coverage of the fabric layers according to the pattern is optimised.

For known manipulation devices, it is often disadvantageous that the movement of the fabric layers transversely to the sewing direction is not achieved with the desired precision.

Therefore, the object of the invention is to create a manipulation device which works with a sewing machine, by which device at least one material web can be moved transversely to the sewing direction in a particularly precise way during the sewing process.

This object is achieved by the invention by a manipulation device having the features of claim 1. Advantageous embodiments of the invention are described in the further claims.

According to the invention, the rolling support unit of the transverse conveying device comprises a joint chain, on which the guiding rollers are arranged, wherein the joint chain is guided around at least two spaced-apart chain sprockets and has a straight pressing portion on which a plurality of guiding rollers is mounted.

The manipulation device according to the invention offers the advantage that the rolling support unit is engaged with the material web to be aligned over a large length, wherein slip between the rolling support unit and the material web is avoided, and the material web can be moved transversely to the sewing direction in a particularly precise way. As the rolling support unit can act on the material web with several guiding rollers at once, the contact pressure of the guiding rollers on the material web can be reduced. This eases the movement of the material web both in the sewing direction and transversely to the sewing direction. Furthermore, the risk, in particular for wide material webs, of the material web twisting during a movement of this kind is reduced. It is particularly preferred when the contact pressure of the guiding rollers on the material web is permanently regulated.

The joint chain preferably consists of a rotary joint chain, i.e., an endless joint chain. It is also possible, however, to employ an open joint chain with two ends, wherein the joint chain is, for example, arranged in a U shape, and is moved by means of movement mechanisms on its end sides.

According to an advantageous embodiment, the manipulation device has two transverse conveying devices and a separating plate for two material webs moved on both sides along the separating plate, wherein a first rolling support unit is arranged above the separating plate and has a straight pressing portion for pressing an upper material web against an upper separating plate surface. Furthermore, a second rolling support unit is arranged below the separating plate. This second rolling support unit has a straight pressing portion for pressing a lower material web against a lower separating plate surface. In this way, two material webs to be sutured together can be aligned with each other transversely to the sewing direction in a very precise and variable way, without the movements of the material webs influencing each other.

Preferably, 2 to 25 guiding rollers, preferably 4 to 18 guiding rollers, particularly preferably 7 to 11 guiding rollers are mounted on the straight pressing portion of the joint chain. The number and size of the guiding rollers can vary widely, however, depending on the respective application.

Preferably, one of the chain sprockets of the joint chain is in driven connection with a chain drive engine via a cardan shaft. A chain drive of this kind offers the advantage that the driving forces can largely be transferred without play. Furthermore, the constructor is very free in the positioning of the chain drive motor, as it must be arranged out of alignment with the driven chain sprocket. Here it is particularly advantageous when the cardan shaft consists of multiple parts which can be shifted relative to each other, such that the length of the cardan shaft can be changed. In this way, it is possible that the chain drive motor can be stationarily arranged, independent of a lifting movement of the rolling support unit.

Preferably, the rolling support unit is fixed on at least one gear rack, which is guided vertically shiftable on a console of the manipulation device and is part of a gear rack drive for vertically shifting the rolling support unit. A gear rack drive of this kind enables an exact, low-play guidance and an exact vertical shifting of the rolling support unit, to move the latter between a contact position lying on the material web and a raised position, and to continuously regulate the contact pressure.

Preferably, every rolling support unit is fixed on two parallel gear racks spaced apart from each other. This enables a tilt-safe guidance of the rolling support units and an even pressing of the guiding rollers over the entire length of the pressing portion of the joint chain.

Preferably, the guiding rollers have a cylindrical or slightly spherical shape and are arranged in such a way that they can be pressed onto the material web along a contact region, which extends at least over the predominant part of the length of the guiding rollers, preferably over the entire length. "Slightly spherical" means that the radius of the surface curvature along the length of the guiding rollers is greater than 50 mm, and preferably greater than 80 mm. For example, the radius is 100 mm for a guiding roller length of 20 mm. In this way, a long linear contact region between the guiding rollers and the material web is created, which ensures to a particularly high degree that no slip arises between the guiding rollers and the material web, and the material web immediately follows every movement of the guiding rollers transversely to the sewing direction. At the same time, the contact pressure of the guiding rollers can be kept low. The transverse conveying movement of the material web can thus be achieved in a way which is very exact, fast, crease-free and protects the material.

Preferably, the guiding rollers have a friction-enhancing, three-dimensionally structured surface. In particular, the surface can have grooving, embossing, or a plurality of small, preferably pyramid-shaped or cone-shaped elevations, which prevent slip between the guiding rollers and the material web in a particularly effective way. Additionally or alternatively, the guiding rollers can also have a friction-enhancing coating or cladding.

Preferably, the guiding rollers are mounted on holding members, which extend away from the joint chain, particularly laterally outwards, such that the guiding rollers are arranged spaced apart from the joint chain, particularly laterally besides the joint chain. According to this embodiment, the guiding rollers do not engage with the chain sprockets. The guiding rollers can therefore be configured independently of the chain sprockets, and be optimised with regards to their material web guiding function. Likewise, joint chains and chain sprockets can also be optimised with regards to absence of play and guidance precision, and be formed independently of the guiding rollers.

Preferably, the holding members have a bearing limb for bearing the guiding rollers which is formed as a cantilever engaging on one side in the guiding rollers. This enables a simple mounting and, where required, a simple changing of guiding rollers.

Preferably, the joint chain is formed as a roller chain, which has outer lugs, inner lugs, chain bolts and rollers, wherein the holding members, on which the guiding rollers are mounted, have a portion which forms an outer lug. In this way, a particularly precisely working, highly resilient roller chain can be created, wherein at the same time the holding members on which the guiding rollers are mounted are integrated into the roller chain in a particularly stable, simple and material-saving manner.

Figure 2:
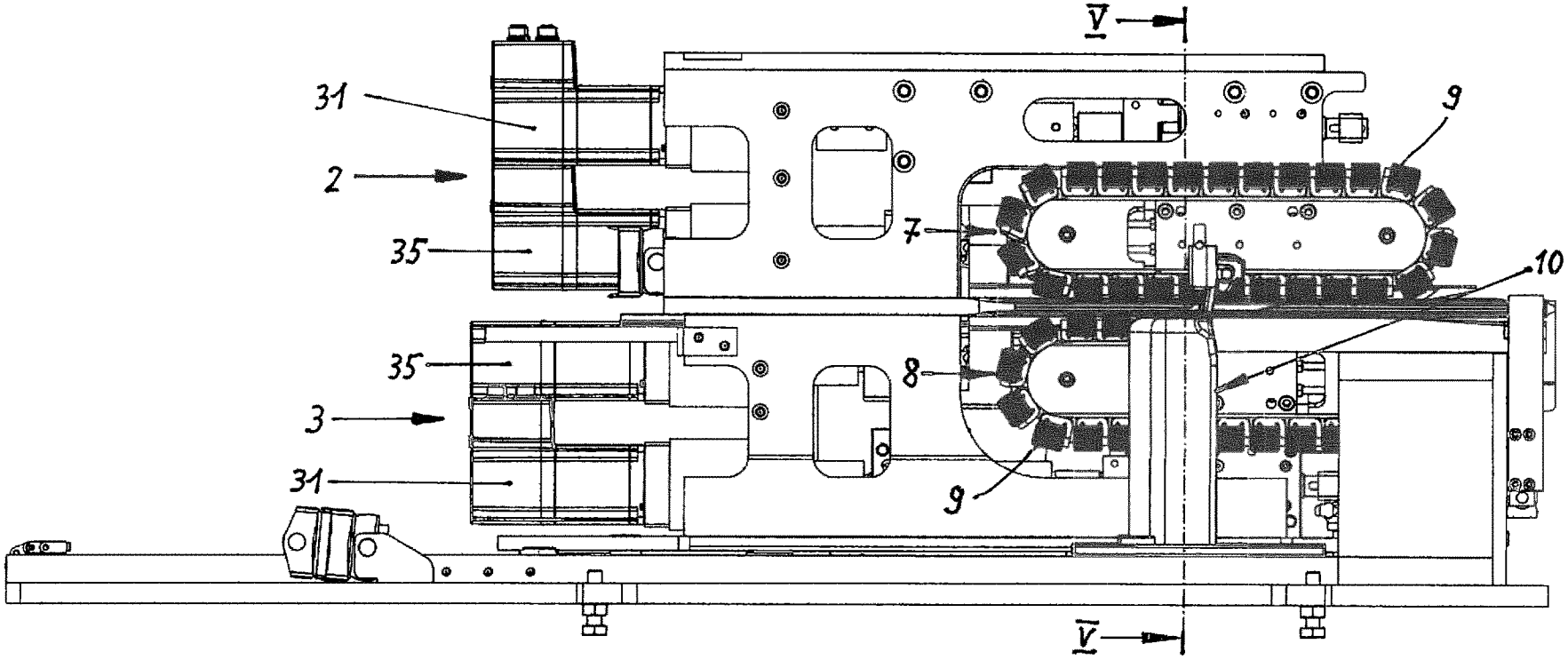
Figure 3:
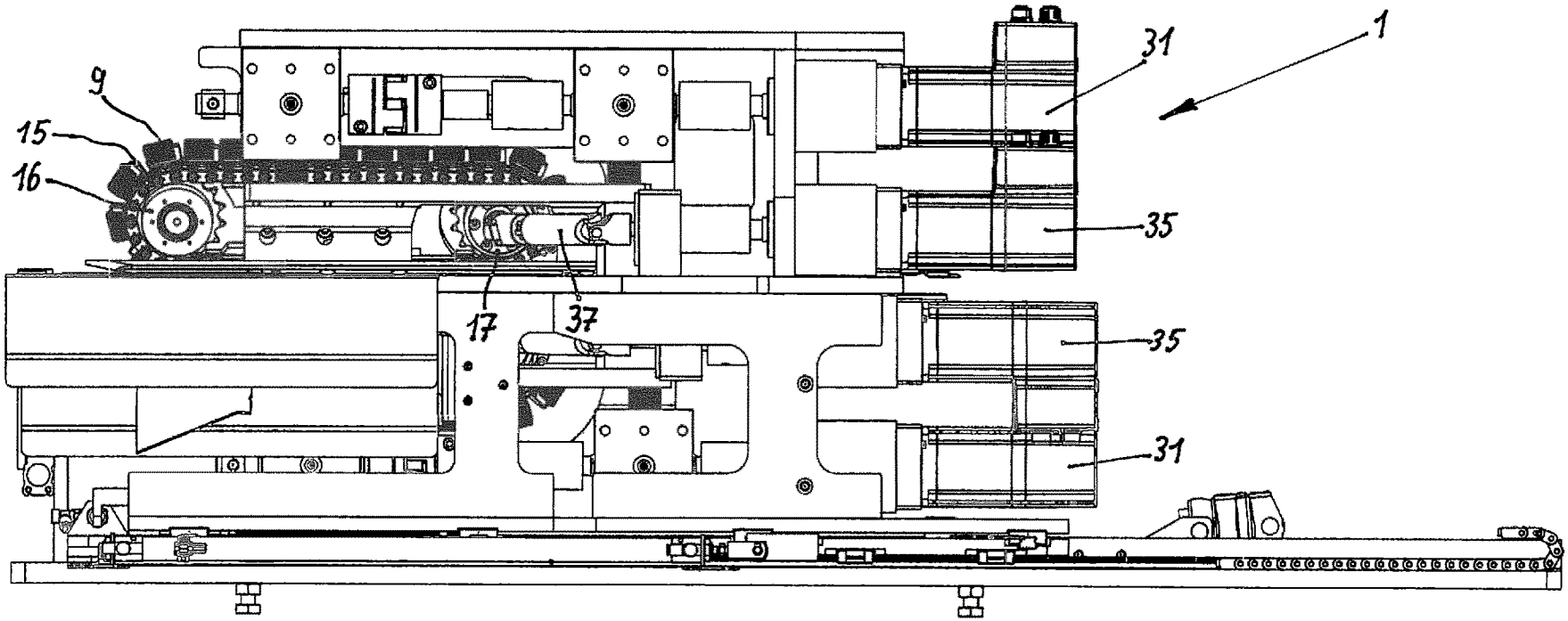

The invention is explained in more detail below with reference to the drawings in an exemplary form. Here:

FIG. 1: shows a spatial representation of the manipulation device according to the invention, and several schematically represented components of a sewing machine, FIG. 2: shows a side view of the manipulation device from the side of the sewing machine, FIG. 3: shows a side view of the manipulation device from the side turned away from the sewing machine, wherein some areas are represented exposed.

Figure 4:
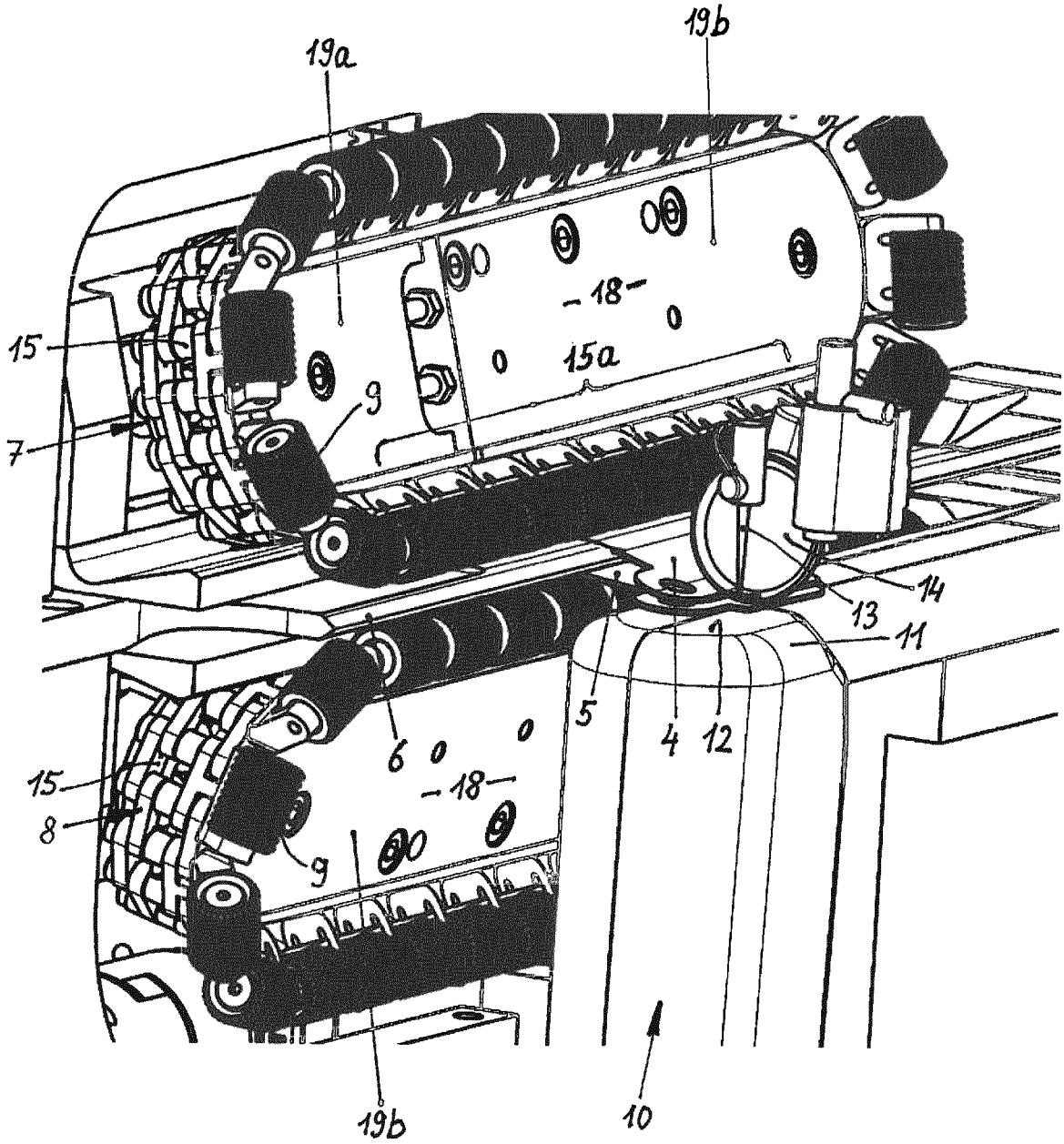
Figure 5:
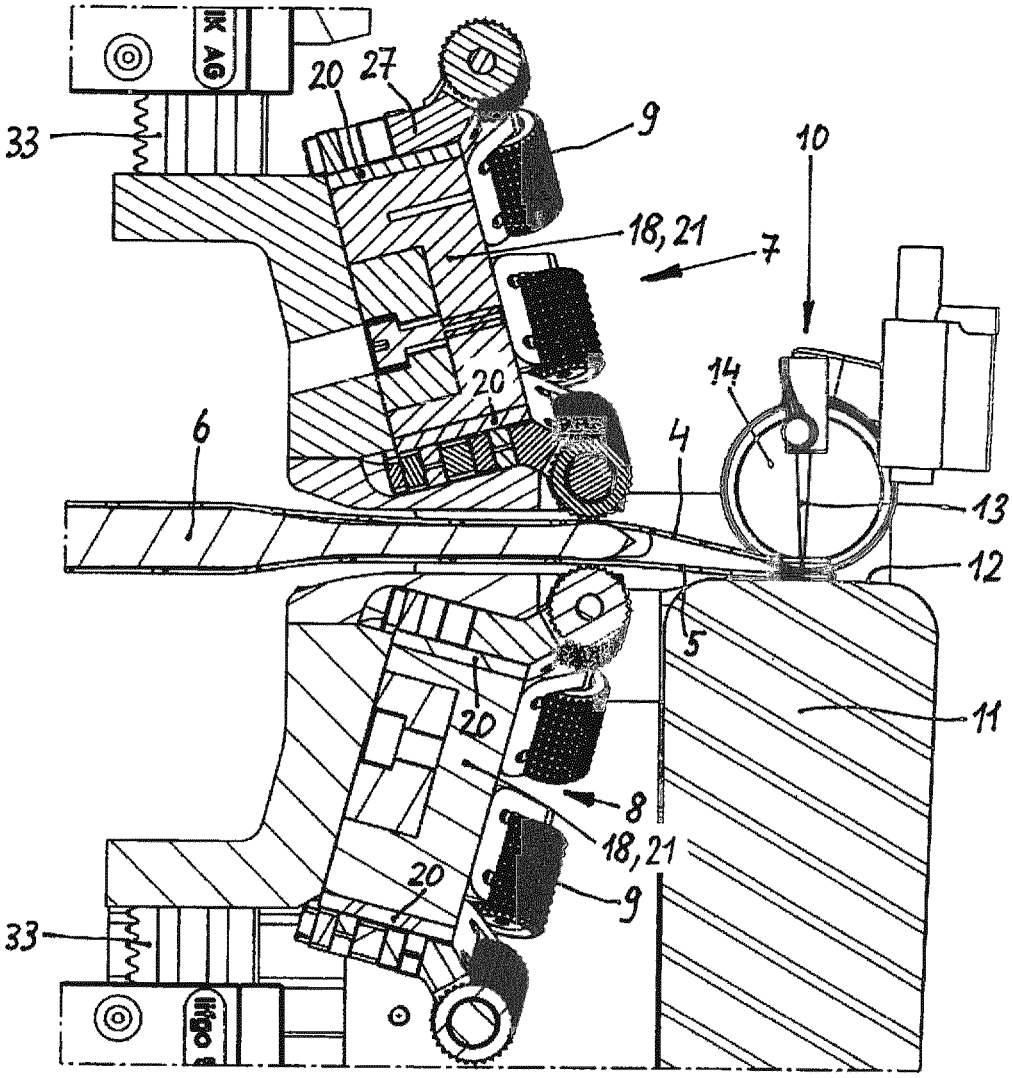
Figure 6:
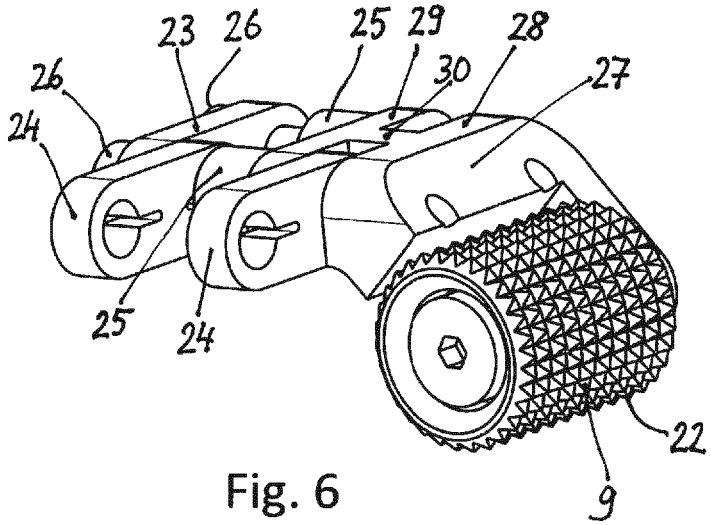
Figure 8:
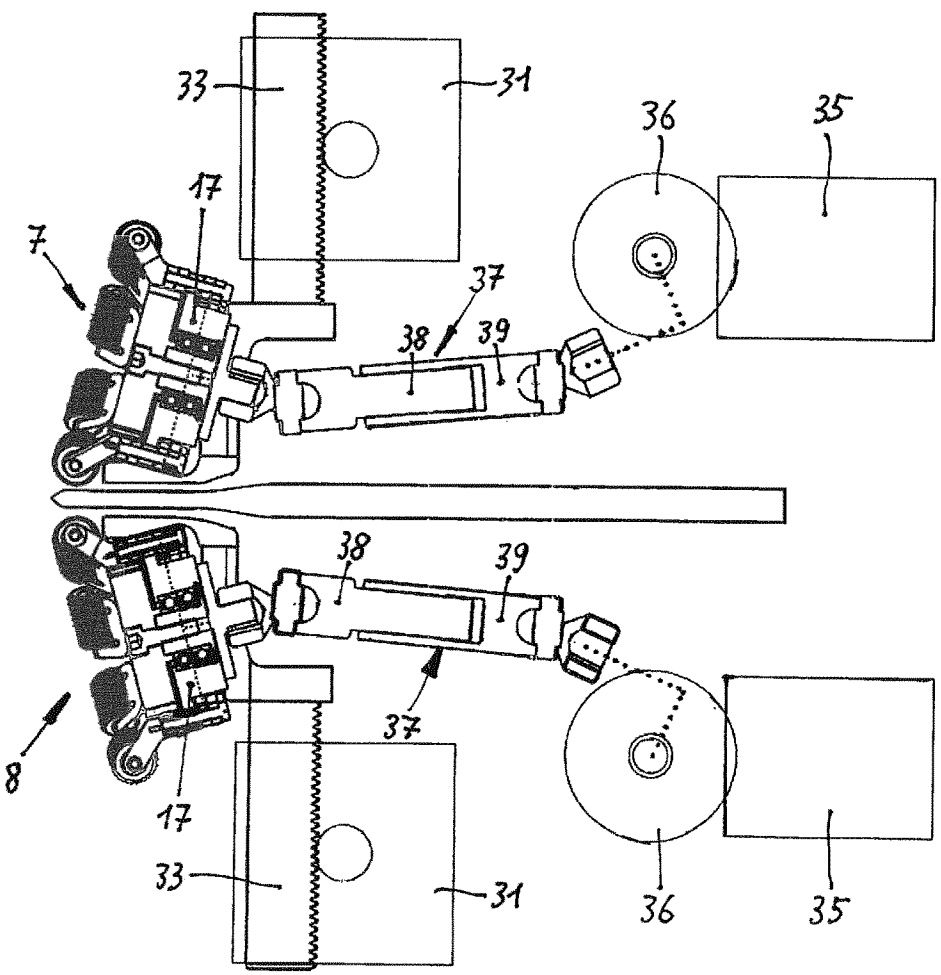
Figure 7:
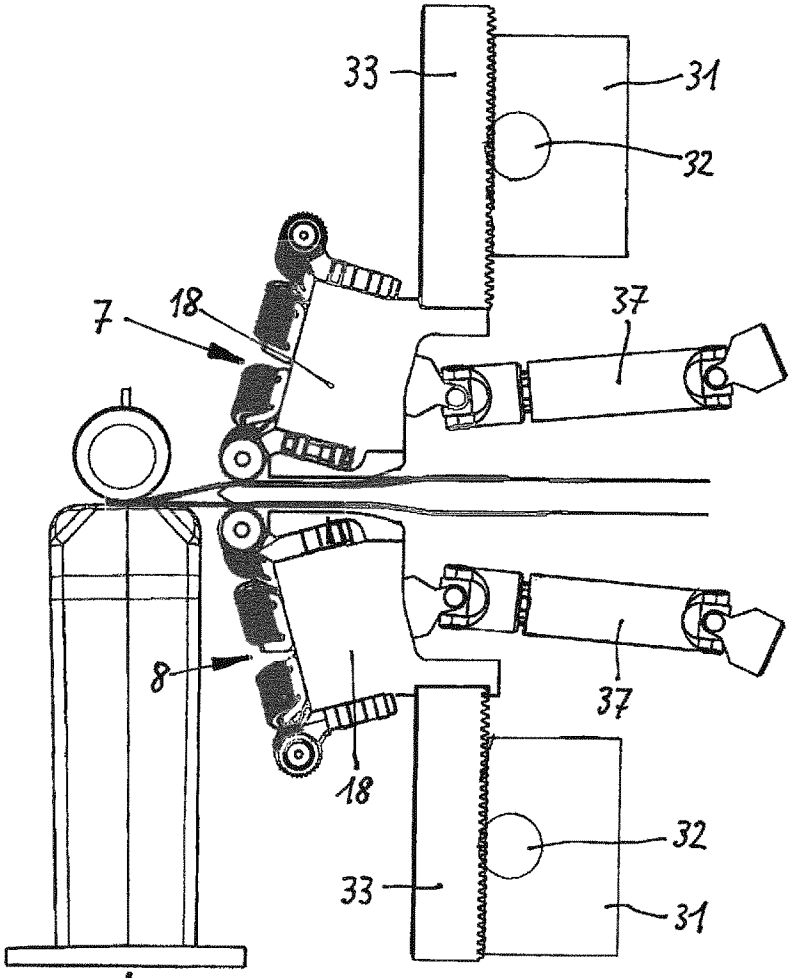

FIG. 4: shows an enlarged section of the manipulation device which shows the rolling support units, FIG. 5: shows a vertical cut through the manipulation device along the line V-V of FIG. 2, FIG. 6: shows a portion of a joint chain, having guiding rollers fixed on it, FIG. 7: shows a partially schematic representation to illustrate the device for vertically shifting the rolling support units, and FIG. 8: shows a partially schematic representation to illustrate the chain drives of the rolling support units.

FIGS. 1-3 show a manipulation device 1, having an upper transverse conveying device 2 and a lower transverse conveying device 3, by which an upper material web 4 and a lower material web 5 can be moved during the sewing, transverse to the sewing direction x, i.e., in the y direction. The two transverse conveying devices 2, 3 are the same in terms of the basic structure.

Between the upper transverse conveying device 2 and the lower conveying device 3 there is a separating plate 6, which is arranged horizontally in the exemplary embodiment shown.

The upper material web 4 is fed, by means of a feeding device (not depicted) of the manipulation device 1 in such a way that it lies on an upper separating plate surface 6*a* (cf. FIGS. 4 and 5). The lower material web 5 is fed below the separating plate 6 in such a way that it lies on a lower separating plate surface 6*b*.

The transverse conveying devices 2, 3 respectively have a rolling support unit 7, 8, which bears a plurality of freely rotatable guiding rollers 9 which can be relocated or positioned transverse to the sewing direction, and yet in a precisely controlled manner.

The rolling support units 7, 8 can be moved, by means of a lifting device described later in more detail, in the vertical direction, i.e., towards and away from the separating plate 6. In the sewing operation shown in FIG. 5, several guiding rollers 9 of the upper rolling support unit 7 preferably lie on the upper material web 4, and press it against the upper separating plate surface 6*a*. If these guiding rollers 9 are moved transversely to the sewing direction in this state, then the upper material web 4 is correspondingly picked up and moved in the transverse direction, i.e., in the y direction.

In the same way, in the sewing operation, one or preferably several guiding rollers 9 of the lower rolling support unit 8 lie on the lower material web 5, and press it against the lower separating plate surface 6*b*. If these guiding rollers 9 are moved transversely to the sewing direction, then the lower material web 5 is moved with it in a corresponding way in the transverse direction, i.e., in the y direction.

The transverse conveying devices 2, 3 serve, in this way, to align the material webs 4, 5 exactly to each other, transversely to the sewing direction, or to bring them into the desired position relative to each other. The alignment can, for example, be achieved in such a way that a (for example curved) edge of the upper material web 4 is exactly aligned with a (for example curved) edge of the lower material web 5, or they are brought into a predetermined position relative to each other, or that markings which are provided on the upper and lower material webs 4, 5 are aligned with, or brought into a predetermined position relative to, each other.

The material webs 4, 5, aligned exactly with each other by means of the transverse conveying devices 2, 3, are fed to an adjacent sewing machine 10, which is only partially represented. The sewing machine 10 comprises, in a known way, a sewing table 11, having a contact surface 12 for the material webs 4, 5 to be sewn together, and a sewing needle 13 which can be moved at least in the vertical direction. An upper material transport device 14 in the form of a drive wheel, and a lower material transport device integrated into the sewing table 11, which is not represented in more detail, ensure the feeding of the material webs 4, 5 in the sewing direction, i.e., in the x direction. In this way, the two material webs 4, 5 are pulled by the sewing machine 10 through the manipulation device 1 in the x direction.

The two rolling support units 7, 8 respectively comprise a rotary joint chain 15, to which the guiding rollers 9 are fixed. The joint chains 15 are respectively guided around two spaced-apart chain sprockets 16, 17 (cf. FIG. 3). In the exemplary embodiment represented, the chain sprockets 16, 17 are spaced apart from each other in the horizontal direction, wherein they have the same size. Different sizes of the chain sprockets 16, 17 are conceivable.

The two chain sprockets 16, 17 are rotatably mounted in a central body 18. As is evident from FIG. 4, the central body 18 can consist of two clamping parts 19*a*, 19*b*, in which a chain sprocket 16, 17 is respectively mounted. The horizontal spacing of the clamping parts 19*a*, 19*b* can be changed to adjust the tension of the joint chain 15.

The central body 18 has an elongated, level contact surface for the joint chain 15 on its upper and lower length. As is evident from FIG. 5, this contact surface can consist of a separate material layer 20, which is fixed on the outer circumference of a core 21 of the central body 18, and can consist of a material with a low friction coefficient, in particular plastic with good gliding properties. In this way, the central body 18 serves to support the straight portion of the joint chain 15 between the chain sprockets 16, 17, such that when the guiding rollers 9 press on the material web 4, 5, the guiding rollers 9 do not deviate, but can be pressed onto the material web 4, 5 with a precisely defined pressure.

In this way, every joint chain 15 has a straight pressing portion 15*a*, on which a plurality of guiding rollers 9 are mounted in alignment with each other. In the exemplary embodiment represented, nine guiding rollers 9 are in the straight pressing portion 15*a*. This number can vary widely.

The guiding rollers 9 of the joint chains 15 are formed in the same way, and have a cylindrical form or outer contour. The contact region having the material web 4, 5 extends in this way over the predominant part of the length of the guiding rollers 9, preferably over the entire length of the guiding rollers 9. Furthermore, the guiding rollers 9 are arranged with a small mutual spacing on the joint chain 15, which likewise maximises the contact area with the material web 4, 5.

From FIG. 6, it is evident that the guiding rollers 9 have a friction-enhancing, three-dimensionally structured surface. This is formed, in the exemplary embodiment depicted, by a plurality of small, pyramid-shaped points 22. These can be slightly pushed into the material web 4, 5, whereby slip between the guiding rollers 9 and the material web 4, 5 is prevented in a particularly effective way.

From FIGS. 4 and 6, it is evident that the joint chains 15 are formed as roller chains. The joint chains 15 have outer lugs 23, inner lugs 24, rollers 25 and chain bolts 26, which are guided through the outer lugs 23, inner lugs 24 and rollers 25.

As is evident from FIG. 6, the guiding rollers 9 are rotatably mounted on holding members 27, which protrude outwards to the side from the joint chain 15, such that the guiding rollers 9 are arranged to the side of the joint chain 15. Here, the holding members 27 have a portion which is formed as an outer lug element 28 of the joint chain 15. Furthermore, the holding members 27 comprise a portion which is formed as an inner lug element 29 of the joint chain 15, arranged spaced apart from the outer lug element 28, and connected to the outer lug element 28 via a central bar 30. The gap between the outer lug element 28 and inner lug element 29 serves for the pivotable mounting of inner lugs 24.

The holding members 27 further have a bearing limb for bearing the guiding rollers 9, which is formed as a cantilever engaging on one side in the guiding rollers 9. This bearing limb forms the longitudinal axis of the guiding rollers 9. These longitudinal axes run in the longitudinal direction of the joint chain 15, and thus on a plane which runs transversely to the sewing direction, i.e., transversely to the x direction.

The guiding rollers 9 are freely rotatably mounted on the associated bearing limbs of the holding members 27, such that the material webs 4, 5 can be pulled by the sewing machine 10 in the sewing direction, i.e., in the x direction, without great resistance. By contrast, in their longitudinal direction, the guiding rollers 9 are mounted on the associated bearing limbs as free of play as possible, such that they can transfer a movement of the joint chains 15, transversely to the sewing direction, to the material webs 4, 5 without slip.

As is evident, for example, from FIG. 5, the guiding rollers 9 of each transverse conveying device 2, 3 move in a work plane which is arranged transversely to the sewing direction, but tilted towards the main plane of the separating plate 6. The two work planes of the upper rolling support unit 7 and lower rolling support unit 8 are here arranged in a V formation. This offers the advantage that the required vertical space for the rolling support units 7, 8 is reduced in the portion which lies behind the joint chains 15. Furthermore, an optimal field of vision for a camera is hereby created.

The rolling support units 7, 8 can be moved vertically (i.e., in the z direction) by means of a lifting device, which is schematically represented in FIG. 7. For each rolling support unit 7, 8, the lifting device comprises a motor 31, in particular a step motor, which, via a drive shaft, operates two gear rack drives spaced apart from each other. Each gear rack drive comprises a drive cog 32, which is engaged in a vertically movable gear rack 33. The gear racks 33 are shiftably mounted in a console 34 (FIG. 1) of the upper or lower transverse conveying device 2, 3. Furthermore, as is evident from FIGS. 5 and 7, the central body 18 of the rolling support units 7, 8 is fixed on the gear racks 33. If the gear racks 33 are vertically displaced by means of the motors 31, the rolling support units 7, 8, and thereby the joint chains 15, are correspondingly moved with them.

FIG. 8 schematically shows the chain drives for the joint chains 15. The two joint chains 15 are here moved via separate chain drives, which are individually controlled such that the two joint chains 15 can move the upper and lower material web 4, 5 individually and independently of each other transversely to the sewing direction.

Each chain drive comprises a drive motor 35, which is connected to a cardan shaft 37 via a gearbox 36, and can move said cardan shaft in rotation. The cardan shaft 37 is connected to one of the chain sprockets 16, 17 of the associated rolling support unit 7, 8 in a rotation-proof manner. If this chain sprocket 16, 17 is turned by a particular degree, the joint chain 15, and thus the guiding rollers 19 fixed on the latter, are correspondingly moved with it.

As is evident from FIG. 8, the two cardan shafts 37 are formed in a length-adjustable manner to compensate for differences in spacing between the gearbox 36 and the driven chain sprocket 16 or 17 by a lifting movement of the rolling support units 7, 8. For this purpose, each cardan shaft 37 has a first cardan shaft part 38 and a second cardan shaft part 39, which engage in each other in a length-adjustable manner, but are connected to each other in a rotation-proof manner.

The drive motors 35 of the chain drives are controlled by electronic control on the basis of signals, which are generated by means of at least one camera which is not represented. In this way, the camera can, for example, record laser markers, which are projected onto the material webs 4, 5 depending on target position deviations, and emit corresponding deviation signals. The drive motors 35 are then controlled in such a way that the target position deviations are minimised. Laser-supported position recording offers the advantage that the recording of the positions of the material webs 4, 5 is very precise and independent of the ambient light. Alternatively to laser-supported position recording, other position recording methods are also possible, in particular those which employ an automated contour or pattern recognition.

The manipulation device 1 according to the invention enables not only the particularly precise alignment and suturing of congruent material cuts, but in particular also the particularly exact, fast and fully automated suturing of incongruent material cuts in the production of three-dimensional sewn coverings.

The invention claimed is:

1. A manipulation device for material webs to be sutured by means of a sewing machine, having at least one transverse conveying device for moving a material web while sewing transversely to the sewing device, wherein the transverse conveying device has a rolling support unit having freely rotatable guiding rollers, which can be pressed onto the material web and can be moved in a controlled manner transversely to the sewing direction, wherein the rolling support unit of the transverse conveying device comprises a joint chain, on which the guiding rollers are arranged, wherein the joint chain is guided around at least two spaced-apart chain sprockets and has a straight pressing portion on which a plurality of guiding rollers is mounted, and wherein the guiding rollers are mounted on holding members, which extend away from the joint chain, such that the guiding rollers are arranged spaced apart from the joint chain.

2. The manipulation device according to claim 1, wherein the manipulation device has two transverse conveying devices and a separating plate for two material webs moved on both sides along the separating plate, wherein a first rolling support unit is arranged above the separating plate and has a straight pressing portion for pressing an upper material web against an upper separating plate surface, and wherein a second rolling support unit is arranged below the separating plate and has a straight pressing portion for pressing a lower material web against a lower separating plate surface.

3. The manipulation device according to claim 1, wherein 2 to 25 guiding rollers are mounted on the straight pressing potion of the joint chain.

4. The manipulation device according to claim 1, wherein one of the chain sprockets of the joint chain is in driven connection with a drive engine via a cardan shaft.

5. The manipulation device according to claim 1, wherein the rolling support unit is fixed on at least one gear rack which is mounted vertically shiftable in a guide console of the manipulation device and is part of a gear rack drive for vertically shifting the rolling support unit.

6. The manipulation device according to claim 5, wherein the rolling support unit is fixed on two parallel gear racks spaced apart from each other.

7. The manipulation device according to claim 1, wherein the guiding rollers have a cylindrical or slightly spherical shape and are arranged in such a way that they can be pressed onto the material web along a contact region, which extends at least across the predominant part of the length of the guiding rollers.

8. The manipulation device according to claim 1, wherein the guiding rollers form a friction-enhancing, three-dimensionally structured surface.

9. The manipulation device according to claim 1, wherein the holding members have a bearing limb for bearing the guiding rollers which is formed as a cantilever engaging on one side in the guiding rollers.

10. The manipulation device according to claim 1, wherein that the joint chain is formed as a roller chain, which has outer lugs, inner lugs, chain bolts and rollers, wherein the holding members, on which the guiding rollers are mounted, have a portion which forms an outer lug element.

* * * * *